United States Patent [19]

Stahlecker

[11] Patent Number: 4,539,807

[45] Date of Patent: Sep. 10, 1985

[54] OPEN END FRICTION SPINNING APPARATUS

[75] Inventor: Fritz Stahlecker, Josef-Neidhart-Strasse 18, 7347 Bad Ueberkingen, Fed. Rep. of Germany

[73] Assignees: Hans Stahlecker; Fritz Stahlecker, both of Del.X

[21] Appl. No.: 558,281

[22] Filed: Dec. 5, 1983

[30] Foreign Application Priority Data

Jan. 11, 1982 [DE] Fed. Rep. of Germany ..... 3300637

[51] Int. Cl.[3] ..... D01H 7/882

[52] U.S. Cl. ..... 57/401; 57/406; 57/407

[58] Field of Search ..... 57/400, 401, 406, 407

[56] References Cited

U.S. PATENT DOCUMENTS

| | | | |
|---|---|---|---|
| 3,861,132 | 1/1975 | Stahlecker et al. | 57/407 |
| 4,109,451 | 8/1978 | Yamada et al. | 57/407 X |
| 4,202,163 | 5/1980 | Turk et al. | 57/401 |
| 4,399,650 | 8/1983 | Parker et al. | 57/401 |

*Primary Examiner*—John Petrakes

*Attorney, Agent, or Firm*—Barnes & Thornburg

[57] ABSTRACT

Open end friction spinning apparatus is provided in which there are one or more spinning units with respectively two adjacently arranged rollers, rotating in the same direction, and disposed to form a wedge shaped gap therebetween for accepting fibers and spinning them into a thread of yarn. A housing is provided for each spinning unit, which housing includes a stationary housing part carrying bearing devices for the rollers and a hingedly mounted cover type housing part connected at a pivot axle. The cover type housing part carries at least a part of a feeding channel for feeding fibers to the rollers to be spun.

35 Claims, 7 Drawing Figures

43
42

28
29
33
2
18
1
27
II
II
37
26
32
31
19
23
III
24
20
21
3
13
15
25
4
IV
IV
6
7
22
8
9
10

OPEN END FRICTION SPINNING APPARATUS

BACKGROUND AND SUMMARY OF THE INVENTION

The invention relates to an open end friction spinning machine having spinning units with two friction rollers driven in the same direction and arranged adjacent to one another to form a wedge shaped gap within which fibers are spun to form yarn or thread. The spinning units of the type contemplated by the invention also include opening apparatus for opening or separating fiber material to be processed and a fiber feed channel opening oppositely of one of the cover surfaces of at least one of the rollers designed as a suction roller. Yarn or thread withdrawl apparatus for withdrawing the formed yarn in the direction of the wedge is also provided for each spinning unit. The rollers are enclosed by a housing in which the feed channel extends.

With an open end friction spinning apparatus of the abovementioned kind dislosed in DE-OS (German published application) No. 27 14 089, both rollers are completely enclosed by a housing which is connected to a vacuum or under pressure source. It should thereby be achieved that there exists a stepwise decreasing graduation of the vacuum pressure between the region of the fiber inlet and opening apparatus, the fiber feeding channel, the housing, and the inside of the suction rollers. With an open end friction spinning machine of the indicated kind, the maintenance is especially problematical because it becomes necessary to have free access to at least portions of the friction rollers, and especially in the region of the wedge slot, for example, after a thread break.

The present invention is based upon the problem to so construct an open end friction spinning machine of the abovedescribed kind, that there is a good protection against the penetration of contamination, especially fiber fly, which can decisively hinder the spinning process, while at the same time, however, not decreasing/-hindering the maintenance possibilities.

These problems are thereby solved by this invention by providing that the housing is divided into two housing parts approximately in the plane of the separation line between the axes of the rollers and wherein the housing part at the side opposite of the feed channel is arranged at the machine frame and the other housing part is formed as a removable cover which includes an inlet guide portion of the fiber feed channel.

With this construction, it is possible in a simple manner with a simple hand grip to selectively gain free access to the rollers and especially the wedge slot, while also maintaining a good protection against the penetration of contaminants into the vacuum pressure regions.

In an advantageous form of the invention, it is proposed that the two housing parts only surround and enclose the circumferential yarn forming surface portions of the rollers and leave the front sides of the rollers free. In order to adequately prevent the penetration of the contaminants it is sufficient to only cover the circumferential surface of the rollers in the region where the vacuum pressure occurs. It has been learned according to the invention that it is not necessary to provide a completely closed housing.

In further preferred embodiments of the invention, the housing part which is arranged stationarily on the machine frame extends or protrudes over the facing sides of the rollers and is provided with bearing receptacles for the rollers. This arrangement results in an especially advantageous design of the construction.

In advantageous preferred embodiments of the invention, it is further provided that the housing part formed as a cover is pivotably mounted at a pivot axle. Thereby, it is further assured according to the invention, that the cover can be returned from the maintenance position into the driving position without adjustments being necessary. The parts that operate together during the spinning process remain adjusted with respect to one another. In especially advantageous embodiments, the cover is held with a pivot axle at the stationary housing part. Thereby it is assured that the housing parts remain exactly disposed with respect to one another and that also, especially when the rollers are carried by bearings in the stationary housing part, exact alignment of the cover with respect to the rollers is maintained.

In preferred embodiments of the invention it is provided that the inner contour of the cover part of the housing is shaped to conform to the coated surfaces of the rollers which are covered by the cover when in the closed position.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 4:
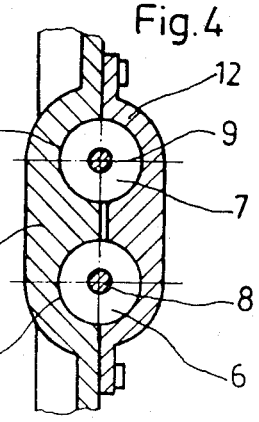
FIG. 4 is a partial sectional view along the line IV—IV of FIG. 1.

The open end friction spinning unit shown in the drawings, together with a plurality of similar units disposed in a row form a spinning machine. The spinning unit includes two vertically disposed friction spinning rollers 1 and 2 arranged parallel to and closely adjacent to one another on shafts 8 and 9 in such a manner that their circumferential surface areas form a wedge shaped gap 3 together with one another. The twisting of fibers into a thread or yarn 42 takes place in wedge slot 3. Yarn 42 is drawn off by withdrawal device 43 in the direction of the wedge slot 3, advantageously through the shown withdrawal roller pair of the withdrawal device 43. The shafts 8 and 9 of the rollers 1 and 2 are carried in a carrying or bearing body 4 disposed with bearing receptacles 11 for bearing housings 6 and 7. The bearing housings 6 and 7 are held in position by means of cover 12 which is screwed into position (FIG. 4). The shafts 8 and 9 protrude through the bearing housings 6 and 7 at the side opposite the rollers 1 and 2 and form driving wharves or shafts which are driven by tangential belt 10 to rotate in the same rotational direction.

The two rollers 1 and 2 are constructed as suction rollers. For this they possess perforated surface coatings and are respectively provided at the inside with inserts 16 and 17 which open into and face the wedge shaped gap 3. The inserts 16 and 17 are connected in a not further illustrated manner to a vacuum source, so that, in the region of the wedge shaped gap 3, suction air flow takes place toward the inside of rollers 1 and 2. The inserts 16 and 17 can be inserted into the rollers 1 and 2 from the end or facing side at the side of the withdrawal apparatus 43. In the illustrated embodiment both rollers 1 and 2 are constructed as suction rollers. In practice, however, it is sufficient according to other preferred embodiments of the invention if only one of the two rollers 1 and 2 is formed as a suction roller if the same has its coated surface turning in toward the wedge shaped gap 3 in which the yarn 42 is formed.

The fiber material to be processed is guided to the wedge shaped gap 3 in the form of individual fibers. For this purpose, an inlet and opening apparatus or device 28 is provided which is only partially illustrated, which opening device can correspond, for example, to the inlet and opening devices of the type which are known for open end rotor spinning machines. The inlet and opening device 28 includes a portion 29 of the fiber feed channel that is disposed oppositely of the portion 19 carried by the cover formed housing part 18. Portion 19 of the fiber feed channel extends up to the wedge shaped gap 3, with the mouth 20 of the feed channel 19 being open to the wedge slot 3. In a modification of the illustrated embodiment, it is provided that the mouth 20 of the feed channel 29, 19 is not disposed immediately adjacent wedge shaped gap 3, but rather at a distance from the wedge shaped gap 3 at a circumferential surface of suction roller 1 or 2, whereby then the fibers are guided by the rotating circumferential surface of the suction roller 1 or 2 to the wedge shaped gap 3.

The circumferential surface portions of the rollers 1 and 2, which are not provided over their entire axial length with perforations, are surrounded in the region of the perforations with a housing that is formed out of stationary part 13 and the already described cover 18, which cover 18 includes and carries the described portion 19 and mouth 20 of the fiber feed channel. The housing serves on the one hand to prevent the penetration of leakage air and on the other hand to prevent penetration of contaminants, especially from the normally occurring fiber fly in a spinning hall. The housing part 13 is formed as a single part with a bearing body 4. Bearing body 4 possesses a somewhat shell shaped contour in the form of a half oval, the edges of which oval extend in the plane through the axes of shafts 8 and 9 of the rollers 1 and 2. At the housing part side opposite the withdrawing apparatus 43, the shell shaped contour is provided with a protrusion 51 which extends into the wedge slot which is disposed oppositely of the fiber guiding wedge shaped gap 3. This protrusion 51 is disposed outside of the region of the rollers 1 and 2 which are provided with the perforations. A corresponding protrusion 51 is also provided in the lower region outside of the region of the perforation of the rollers 1 and 2 so that also here a penetration of leakage air is prevented.

Figure 2:
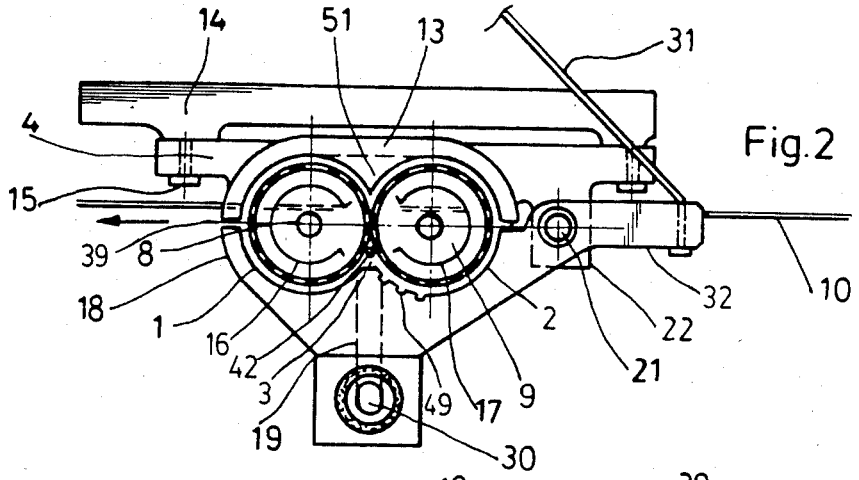
FIG. 2 is a sectional view along the line II—II through the open end friction spinning apparatus of FIG. 1 with a closed housing.

The cover 18 closes with the interposition of elastic sealing strips 39 at the edges of the stationary housing part 13 so that the housing collectively exhibits a separating line extending in the plane of the shafts 8 and 9 of the rollers 1 and 2. The inner contour of the cover 18 is provided with half cylindrical reception openings 50 which are compatible with the contour of the outer coated surface of the rollers 1 and 2. As can be seen in FIG. 2, the inner surface can also be provided with a profiling 49. Profiling 49, which extends in the axial direction of the rollers 1 and 2, operates as a labyrinth seal and is especially recommended if the fiber guiding wedge shaped gap 3 of the outwardly turning roller 2 is not provided as a suction roller, but has a closed coating or cover.

Figure 5:
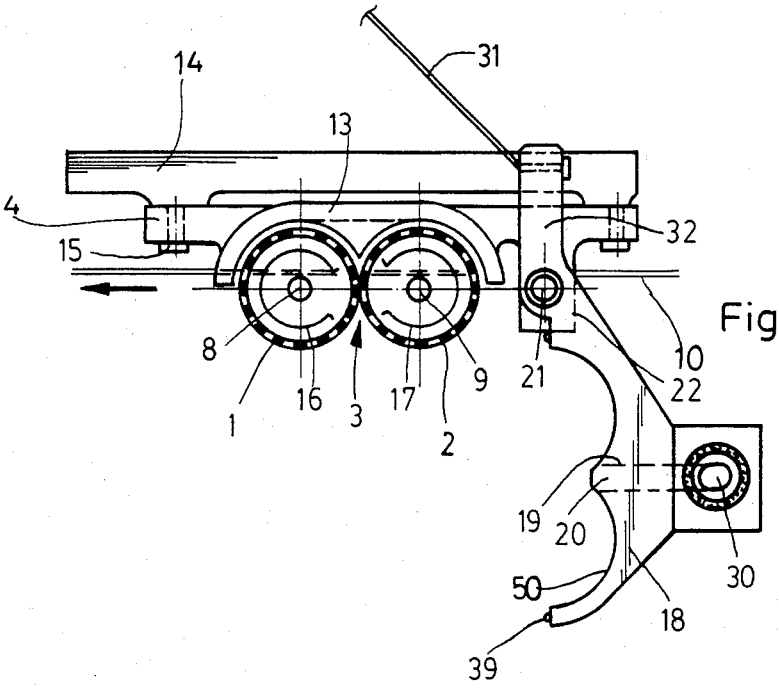
FIG. 5 is a sectional view along line II—II through the open end friction spinning apparatus of FIG. 1, with an open housing.

The housing part cover 18 is disclosed in the illustrated embodiment of FIGS. 1–6 with a pivot axle 21 extending vertically, parallel to and in the plane of the shafts 8 and 9, which axle 21 is supported in a bracket 22 of the stationary housing part 13. A buffer spring formed as a locking spring 24 is arranged between the cover 18 and the pivot axle 21 in the region of an opening 23, which spring 24 holds the cover 18 in its closed position. As can be seen in FIG. 5, the cover 18 can be pivoted at least 90° so that the circumferential surfaces of the rollers 1 and 2, and especially the fiber guiding wedge slot 3, are completely exposed. For operating, the cover 18 is provided with a protrusion 32 extending beyond the pivot axle 21, to which protrusion a draw string or draw wire 31 is connected to facilitate the opening of the cover 18. The closing of cover 18 is effected automatically by means of the locking spring 24 upon the loosening of this draw wire or band 31.

The cover 18 is axially slidably held against the strength of spring 25 at the pivot axle 21 which is formed as a bolt. The cover 18 is pressed by the spring 25 against a protrusion formed as a nut 26, which nut 26 is secured by a counter nut 27 formed as a domed cap nut. During closing, the cover 18 extends against a guide abutment 33, which abutment 33 is stationarily and adjustably arranged. In the illustrated embodiment the guiding abutment 33 is arranged at the inlet and opening apparatus 28, which in turn is disposed so that portion 19 of the feed channel is aligned with portion 29 of the feed channel when cover 18 is closed. An elastic sealing ring 37 is arranged between the cover 18 and the inlet and opening apparatus 28. Ring 37 surrounds both the portions 29 and 19 of the fiber feed. It is also contemplated in other embodiments to arrange the cover 18 so that it is axially fixed at the pivot axle 21 and to further provide that the inlet and opening apparatus 28 is formed somewhat resilient or flexible so that upon closing of the cover 18 the parts are disposed in the desired position.

Figure 3:
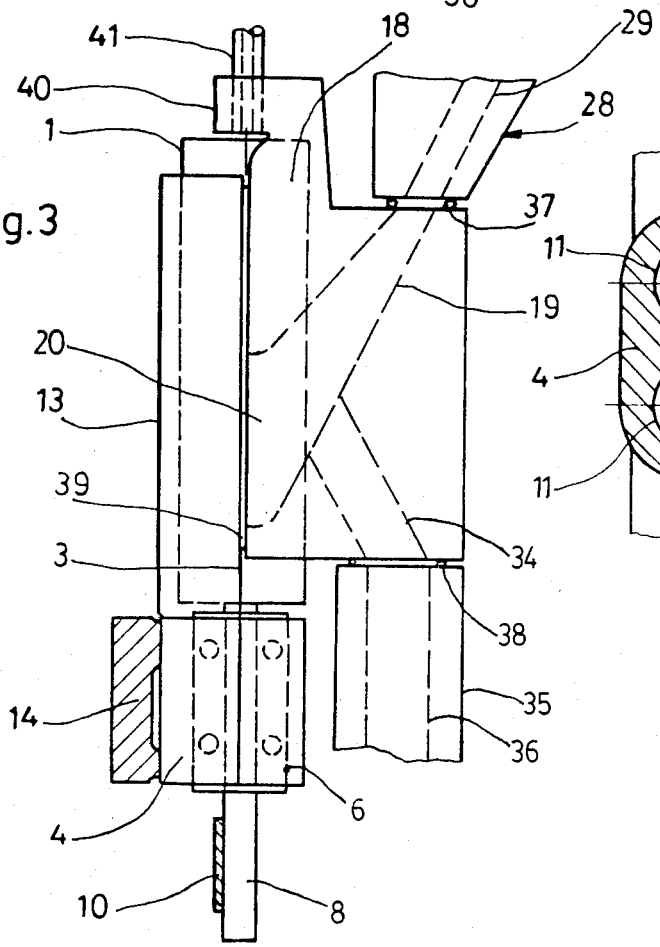
FIG. 3 is a view in the direction of the arrow III of FIG. 1.

As can be seen in FIG. 3, the portion 19 of the feed channel opens into a vacuum channel 34 in the region of its mouth 20, which channel 34 is disposed in the cover 18 and is connected by means of a vacuum pressure connection 36 at a housing 35. Also in this embodiment, a sealing ring 38 is provided between the two vacuum pressure connections. This vacuum pressure arrangement 34, 36 has the purpose to guide the fiber feed.

As can be further seen from FIG. 3, the cover 18 is provided with an elongation 40 at the side of the withdrawal apparatus 43. Elongation or protrusion 40 extends over the free ends of the rollers 1 and 2 and carries a yarn withdrawal channel 41. In the closed position of the cover 19, channel 41 extends with at least the beginning of its opening in alignment with the direction of the fiber guiding wedge shaped gap 3 and extends toward the withdrawal direction for the completed yarn 42.

Figure 6:
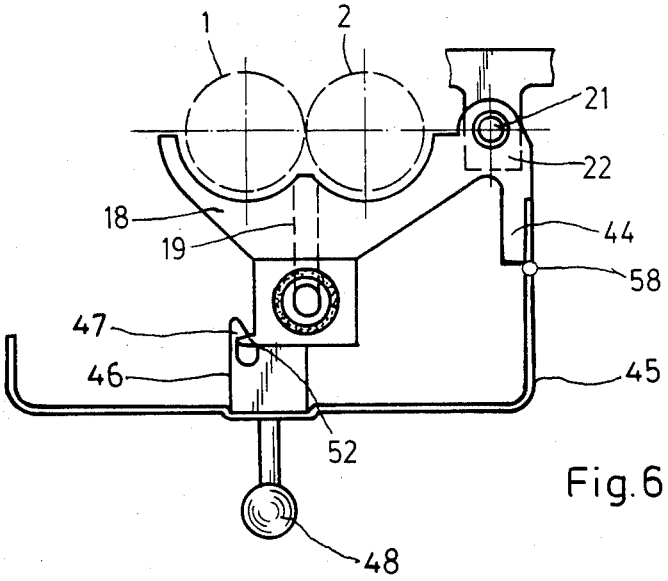
FIG. 6 is a part sectional view similar to FIG. 2, showing a further embodiment of an open end spinning apparatus constructed according to the invention.

In the embodiment of FIG. 6, the housing cover arrangement is similar in principle to the embodiment of FIGS. 1 through 5, with a further cover or shrouding 45 made of sheet metal or plastic and covering the open end friction spinning units, at least in the region of rollers 1 and 2 at the servicing side of the machine. This further cover 45 forms, with the corresponding covering of the adjacent open end friction spinning units a machine with a closed optically pleasing machine front. The cover 45 is fastened at protrusion or extension 44 of the cover 18. The cover 45 includes a latching piece 46 that advantageously is made from synthetic material or plastic and grips with its latching nose 47 at a corresponding nose 52 of the cover 18. The shroud or cover 45 is further provided with a hand grip 48 accommodating opening of same with respect to cover 18. The cover 45 is attached by means of a hinge-like connection 58 at the protrusion 44 so that it can be selectively opened alone by pivoting without opening the cover 18 when the latching connection between the noses 47 and 52 is released.

Figure 1:
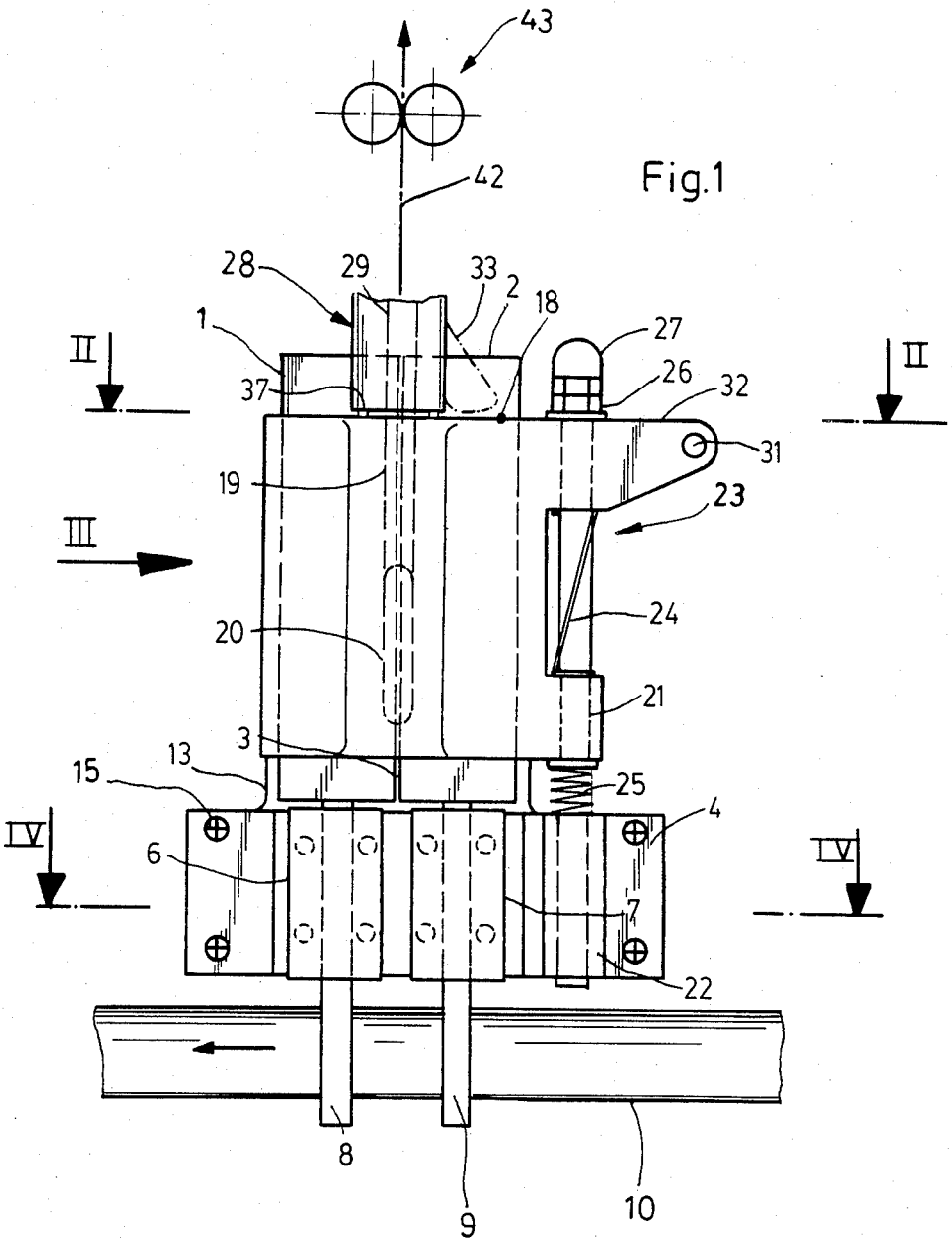
FIG. 1 is a partial side schematic view of an open end friction spinning unit constructed in accordance with a preferred embodiment of the invention, viewed from the servicing side and with the fiber inlet and opening apparatus only partially illustrated.
Figure 7:
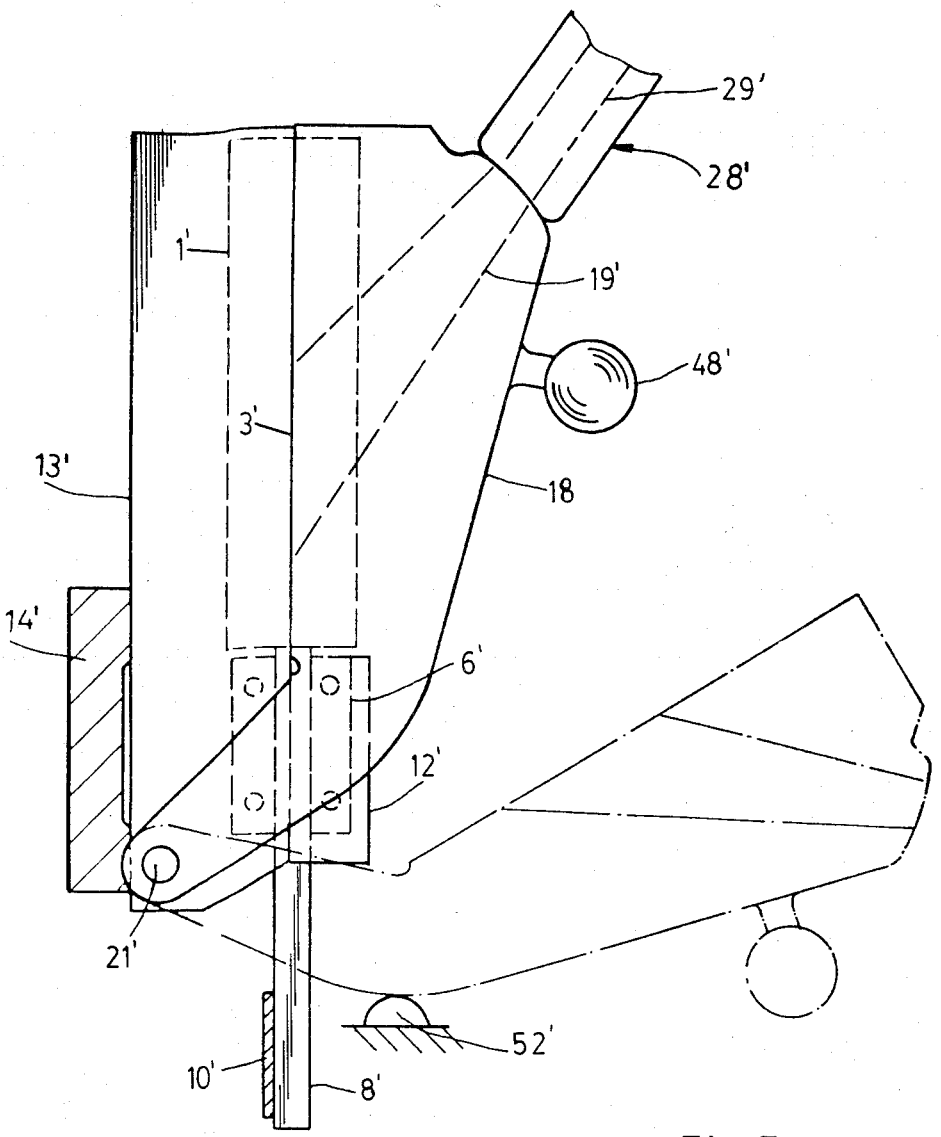
FIG. 7 is a view similar to FIG. 3, showing another embodiment of the present invention, with a pivot axle for the cover extending perpendicular to the axle of the rollers.

The embodiment of FIG. 7 corresponds in principle construction to the embodiment of FIGS. 1-3 so that similar, but primed reference characters are used. In contrast to the embodiment of FIGS. 1-3, the cover 18 is pivotable about an axle 21 which extends perpendicular to the axles of the rollers 1 and 2 and horizontally in the machine longitudinal direction at the fixed housing part 13' at the machine frame 14'. The pivoting movement of the cover 18' is limited by means of an abutment 52 so that cover 18' cannot be pivoted into the position of the tangential belt 10.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open end friction spinning machine having machine frame means and at least one spinning unit, each spinning unit comprising:

a pair of friction rollers disposed adjacent one another to form a wedge shaped yarn forming gap therebetween;

fiber supply means for supplying fibers to the wedge shaped gap, said fiber supply means including fiber feed channel means opening adjacent the wedge-shaped gap;

yarn withdrawing means for withdrawing formed yarn from the wedge shaped gap; and housing means surrounding at least a portion of the friction rollers defining the wedge shaped gap, wherein said housing means includes two housing parts separated from one another in a region of a plane extending substantially parallel to the rotational axes of the friction rollers, a first of said housing parts being disposed at the side of the friction rollers opposite the wedge shaped gap and being arranged at the machine frame means, the second of said housing parts being disposed at the wedge shaped gap side of the friction rollers and being mounted for selective movement between a closed housing position for spinning operations and an open housing position with said wedge shaped gap being accessible from outside, said second housing part further carrying a portion of the fiber feed channel means which opens adjacent to the wedge shaped gap.

2. Open end friction spinning machine having machine frame means and at least one spinning unit, each spinning unit comprising:

a pair of friction rollers disposed adjacent one another to form a wedge shaped yarn forming gap therebetween;

bearing means for rotatably supporting the friction rollers, fiber supply means for supplying fibers to the wedge shaped gap, said fiber supply means including fiber feed channel means opening adjacent the wedge-shaped gap;

yarn withdrawing means for withdrawing formed yarn from the wedge shaped gap; and housing means surrounding at least a portion of the friction rollers defining the wedge shaped gap, wherein said housing means includes two housing parts, a first of said housing parts being disposed at the side of the friction rollers opposite the wedge shaped gap and being arranged at the machine frame means, the second of said housing parts being disposed at the wedge shaped gap side of the friction rollers and being mounted for selective movement between a closed housing position for spinning operations and an open housing position with said wedge shaped gap being accessible from outside, said second housing part further carrying a portion of the fiber feed channel means which opens adjacent to wedge shaped gap, said first housing part extending axially along the length of the friction rollers to form a bearing body support receptacle means for accommodating the bearing means for the roller shafts.

3. Spinning machine according to claim 2, wherein the friction rollers are carried on shafts extending outside the housing means and through the bearings with the ends forming driving wharves engageable with machine belt drive means.

4. Spinning machine according to claim 3, wherein the second housing part is constructed as a housing cover, said housing cover being provided with an extension protruding beyond the ends of the friction roller shafts adjacent the yarn withdrawing means, said extension carrying a yarn withdrawal tube that, with a closed housing cover, extends with at least its beginning adjacent the rollers in the same axial direction as the wedge slot.

5. Spinning machine according to claim 2, wherein the second housing part is constructed as a housing cover, said housing cover being provided with an extension protruding beyond the ends of the friction roller shafts adjacent the yarn withdrawing means, said extension carrying a yarn withdrawal tube that, with a closed housing cover, extends with a least its beginning adjacent the rollers in the same axial direction as the wedge slot.

6. Spinning machine according to claim 2, wherein the second housing part is carried at a pivot axle to be pivotally moveable thereabout.

7. Spinning machine according to claim 6, wherein said first housing part is stationarily supported at the machine frame, and wherein the pivot axle is carried at the first housing part.

8. Spinning machine according to claim 7, wherein locking spring means are provided for resiliently biasing the second housing part toward its closed housing position.

9. Spinning machine according to claim 8, wherein a fixed adjustably movable guide abutment is provided, and wherein axial spring means are disposed to bias the second housing part in the axial direction of the pivot axle and in guiding abutment with the guide abutment during movement of the second housing part toward its closed housing position.

10. Spinning machine according to claim 9, wherein the guide abutment is attached to a stationarily disposed fiber opening and inlet device disposed to open to the fiber feed channel.

11. Spinning machine according to claim 9, wherein the guide abutment is attached at the first housing part.

12. Spinning machine according to claim 2, further comprising vacuum connection means communicating with the fiber feed channel portion in the second housing part.

13. Spinning machine according to claim 2, further comprising vacuum connection means communicating with the fiber feed channel portion in the second housing part.

14. Spinning machine according to claim 2, wherein the inner contour of the second housing part conforms to the outer contour of the friction rollers.

15. Spinning machine according to claim 2, wherein the second housing part is carried at a pivot axle to be pivotally moveable thereabout.

16. Spinning machine according to claim 2, wherein the second housing part is pivotally mounted at an axle extending perpendicular to the axes of the friction rollers, and wherein a stop abutment is provided for limiting the pivoting movement of said second housing part.

17. Spinning machine according to claim 1, wherein the second housing part is pivotally mounted at an axle extending perpendicular to the axes of the friction rollers, and wherein a stop abutment is provided for limiting the pivoting movement of said second housing part.

18. Spinning machine according to claim 2, wherein the first and second housing parts surround the circumference of the rollers and permit the end faces of the rollers to extend outside of the second of said housing parts.

19. Spinning machine according to claim 1, wherein the first housing part protrudes beyond the housing enclosing portions of the friction rollers and is provided with bearing receptacle means for the bearings of the friction rollers.

20. Spinning machine according to claim 19, wherein the friction rollers are carried on shafts extending outside the housing means and through the bearings with the ends forming driving wharves engageable with machine belt drive means.

21. Spinning machine according to claim 20, wherein the second housing part is constructed as a housing cover, said housing cover being provided with an extension protruding beyond the ends of the friction roller shafts adjacent the yarn withdrawing means, said extension carrying a yarn withdrawal tube that, with a closed housing cover, extends with at least its beginning adjacent the rollers in the same axial direction as the wedge slot.

22. Spinning machine according to claim 20, further comprising vacuum connection means communicating with the fiber feed channel portion in the second housing part.

23. Spinning machine according to claim 1, wherein the second housing part is constructed as a housing cover, said housing cover being provided with an extension protruding beyond the ends of the friction roller shafts adjacent the yarn withdrawing means, said extension carrying a yarn withdrawal tube that, with a closed housing cover, extends with at least its beginning adjacent the rollers in the same axial direction as the wedge slot.

24. Spinning machine according to claim 1, wherein the second housing part is carried at a pivot axle to be pivotally moveable thereabout.

25. Spinning machine according to claim 24, wherein said first housing part is stationarily supported at the machine frame, and wherein the pivot axle is carried at the first housing part.

26. Spinning machine according to claim 25, wherein locking spring means are provided for resiliently biasing the second housing part toward its closed housing position.

27. Spinning machine according to claim 26, wherein a fixed adjustably movable guide abutment is provided, and wherein axial spring means are disposed to bias the second housing part in the axial direction of the pivot axle and in guiding abutment with the guide abutment during movement of the second housing part toward its closed housing position.

28. Spinning machine according to claim 27, wherein the guide abutment is attached to a stationarily disposed fiber opening and inlet device disposed to open to the fiber feed channel.

29. Spinning machine according to claim 27, wherein the guide abutment is attached at the first housing part.

30. Spinning machine according to claim 29, further comprising vacuum connection means communicating with the fiber feed channel protion in the second housing part.

31. Spinning machine according to claim 1, further comprising vacuum connection means communicating with the fiber feed channel portion in the second housing part.

32. Spinning machine according to claim 1, wherein the inner contour of the second housing part conforms to the outer contour of the friction rollers.

33. Spinning machine according to claim 1, wherein the second housing part is in turn covered from the outside by a movable further cover, said further cover being pivotally carried at an axle which extends parallel to a pivot axle for the second housing part.

34. Spinning machine according to claim 1, wherein the second housing part is pivotally mounted ast an axle extending perpendicular to the axes of the friction rollers, and wherein a stop abutment is provided for limiting the pivoting movement of said second housing part.

35. Spinning machine according to claim 1, comprising a plurality of said spinning units and common drive means for same.

* * * * *

UNITED STATES PATENT AND TRADEMARK OFFICE

CERTIFICATE OF CORRECTION

PATENT NO. : 4,539,807

DATED : September 10, 1985

INVENTOR(S) : Fritz Stahlecker

It is certified that error appears in the above-identified patent and that said Letters Patent is hereby corrected as shown below:

In [73], line 2, change "both of Del.X" to --both of Federal Republic of Germany--.

Signed and Sealed this

*Seventeenth* Day of *December 1985*

[SEAL]

*Attest:*

DONALD J. QUIGG

*Attesting Officer*

*Commissioner of Patents and Trademarks*